US006342167B1

(12) United States Patent
Kawano et al.

(10) Patent No.: US 6,342,167 B1
(45) Date of Patent: Jan. 29, 2002

(54) SYNTHETIC RESIN MAGNET COMPOSITION AND SYNTHETIC RESIN MAGNET MOLDED-PRODUCT USING THE SAME

(75) Inventors: Kouta Kawano; Hideharu Daifuku, both of Kanagawa (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/559,332

(22) Filed: Apr. 27, 2000

(30) Foreign Application Priority Data

Apr. 27, 1999 (JP) ..... 11-119357

(51) Int. Cl.[7] ..... H01F 7/00

(52) U.S. Cl. ..... 252/62.54; 252/62.55; 399/277

(58) Field of Search ..... 252/62.54, 62.55; 399/277

(56) References Cited

U.S. PATENT DOCUMENTS 3,560,388 A * 2/1971 Higashi ..... 252/62.54

FOREIGN PATENT DOCUMENTS

EP 0 561 445 9/1993
JP 63-33802 A * 2/1988
JP 63-033802 2/1988
JP 8-109244 4/1999

OTHER PUBLICATIONS

Derwent abstract for JP 63–33802, Feb. 13, 1988.*
Japanese Patents abstract for JP 63–33802, Feb. 13, 1988.*
Derwent abstract for JP 8–109244, Apr. 30, 1996.*
8–109244, English Language Translation of the claims, Apr. 30, 1999.
Sakata, M., et al., *Development of Extrusion Molded Nd–Fe–B Magnets*, IEEE Translation Journal on Magnetics in Japan, US, IEEE, Inc., New York, vol. 8, No. 1, 1993, pp. 21–26.

* cited by examiner

*Primary Examiner*—C. Melissa Koslow
(74) *Attorney, Agent, or Firm*—Sughrue Mion, PLLC

(57) ABSTRACT

A synthetic resin magnet composition that can maintain its good melt flowability without deterioration in moldability or in uniformity of magnetic force even when the amount of magnetic powder being filled is increased, and thus, can accomplish an improvement in magnetic characteristic of the molded-product is provided. Further, the synthetic resin magnet composition is used to provide a synthetic resin magnet molded-product, such as a magnetic roller, that can achieve high-magnetization without causing any variation in surface magnetic force or deterioration in dimensional precision. Such a composition is composed by mixing and dispersing a magnetic powder and at least one type of aromatic polyamine compound to a synthetic resin binder.

18 Claims, 1 Drawing Sheet

SYNTHETIC RESIN MAGNET COMPOSITION AND SYNTHETIC RESIN MAGNET MOLDED-PRODUCT USING THE SAME

BACKGROUND OF THE INVENTION

1. Field of the Invention

The present invention relates to a synthetic resin magnet composition composed by mixing and dispersing magnetic powder to a resin binder, and suitably used as a material for molding molded-products such as magnetic rollers used in electro photograph devices or electrographic recording devices. The present invention also relates to synthetic resin magnet molded-products, such as magnetic rollers, parts for motors or magnetic sensors, molded by using the above-mentioned composition. Specifically, the present invention relates to a synthetic resin magnet composition which, when molded such as by injection, extrusion or compression, is improved in flowability in molten-state and in moldability, permits increase in the amount of magnetic powder being filled, and also, has an improved magnetic characteristic; and further relates to synthetic resin magnet molded-products using such a composition.

2. Description of the Related Art

Conventional electro photograph devices and electrographic recording devices, such as copying machines or printers, have been provided with a magnetic roller molded from a synthetic resin magnet within a rotating sleeve, which roller being provided as a developer-roller capable of making visible electrostatic latent images retained on a latent image holder such as a photosensitive drum. For such devices, there have been known developing methods for supplying toner to the surface of the latent image holder and making the latent images visible by means of a so-called "jumping-development phenomenon," wherein a magnetic developing agent (i.e. toner) carried on the surface of the sleeve jumps (transfers) onto the latent image holder by virtue of the magnetic characteristic of the magnetic roller.

Conventionally, the above-described magnetic rollers have been produced by molding a synthetic resin magnet composition, which is formed by mixing a magnetic powder in a thermoplastic resin binder, into a roller-like shape and polarizing it to impart a desired magnetic characteristic thereto, by means of injection-molding or extrusion-molding in a metal mold surrounded by a magnetic field.

Further, with the advancement of the electro photograph devices and other such devices in the recent years, there has been a tendency to demand for the magnetic rollers to possess a more complicating magnetic force pattern. In order to respond to these demands, a plurality of magnet pieces, polarized to have a magnetic polarity according to the desired magnetic force pattern, has been molded from the above-mentioned synthetic resin magnet composition, and these pieces have been adhesively attached together onto the periphery of a shaft to thus create the desired magnetic force pattern.

As for the synthetic resin magnet molded-product such as the magnetic roller, a synthetic resin magnet composition is used which is molded by methods such as injection, extrusion or compression molding. Here, the composition is produced by mixing and kneading magnetic powder, such as ferrites or rare-earth magnets, to a thermoplastic resin such as polyamide resin (such as polyamide-6 or polyamide-12) and polypropylene or other such materials, which resin being used as a main binder.

With the speedup and improvement in precision of the electro photograph devices and electrographic recording devices brought about in the recent years, a demand for a higher magnetization has been rising in the synthetic resin magnet molded-products which are produced by mixing and kneading magnetic powder of ferrites, rare-earth magnet powder or other such materials to a thermoplastic resin such as polyamides used as a main binder. In order to respond to such a demand, there have been made various attempts to increase the amount of magnetic powder being filled to the synthetic resin magnet composition. However, when the amount of magnetic powder being filled is increased, deterioration in both flowability in molten-state and moldability becomes a problem. For this reason, the amount of magnetic powder being filled cannot be increased, and thus, it is difficult to improve the magnetic characteristic of the composition.

SUMMARY OF THE INVENTION

Accordingly, it is an object of the present invention to solve all of the above-mentioned problems, and to provide a synthetic resin magnet composition that can maintain its good melt flowability even when the amount of magnetic powder being filled is increased without deterioration in moldability or in uniformity of magnetic force, and thus, can accomplish the improvement in magnetic characteristic of the molded-product. A further object is to provide a synthetic resin magnet molded-product, such as a magnetic roller, that can achieve high-magnetization without causing any variation in surface magnetic force or deterioration in dimensional precision by using the above-mentioned synthetic resin magnet composition.

As a result of assiduous considerations for solving the above-mentioned problems, the present inventors have come to complete the present invention upon the discovery that by adding an aromatic polyamine compound to a composition for forming a synthetic resin magnet molded-product using a thermoplastic resin as a binder, it is possible to maintain a sufficient melt flowability and an excellent moldability even when the amount of magnetic powder filled is increased; and because the amount of magnetic powder filled can be increased, it becomes possible to realize a higher magnetization compared to conventional ones.

That is, a synthetic resin magnet composition according to one aspect of the present invention is characterized in that it is composed by mixing and dispersing a magnetic powder and at least one type of aromatic polyamine compound in a synthetic resin binder.

In the synthetic resin magnet composition of the present invention, it is preferable that the aromatic polyamine compound is either a compound represented by the following formula:

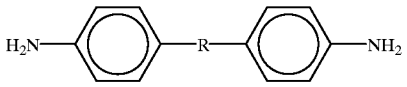

(wherein R is a single bond or a lower alkylene group); or a compound obtained by reacting at least one compound with the above formula with an ether compound having at least one epoxy-group. Further, it is preferable that the ether compound is either a compound represented by the following formula:

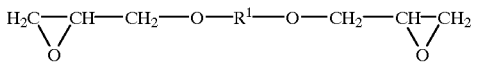

(wherein $R^1$ is an alkylene, a cycloalkylene or an arylene group, each of which may have a substituent); or a compound represented by the following formula:

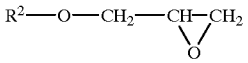

(wherein $R^2$ is an alkyl, a cycloalkyl or an aryl group, each of which may have a substituent). Furthermore, it is preferable that the amount of the aromatic polyamine compound being added is within a range of 0.1–10 wt %.

Further, it is preferable that in the synthetic resin magnet composition of the present invention, the magnetic powder is surface-treated with either a silane coupling agent or a titanate coupling agent; and it is preferable that the resin binder is a polyamide resin.

A synthetic resin magnet molded-product of the present invention is characterized in that it is formed by molding the above-mentioned synthetic resin magnet composition into a desired shape.

BRIEF DESCRIPTION OF THE DRAWINGS

These and other objects and advantages of the present invention will become clear from the following description with reference to the accompanying drawing, wherein.

DESCRIPTION OF THE PREFERRED EMBODIMENTS

Figure 1:
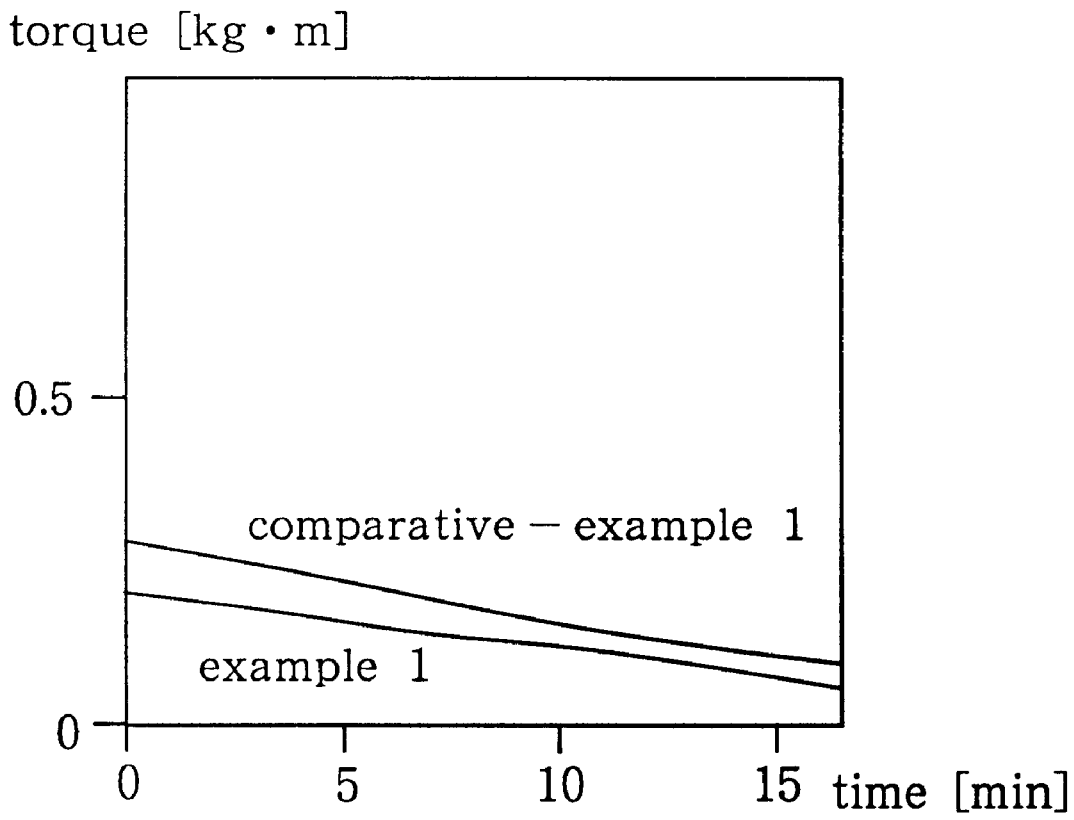
FIG. 1 is a graph showing the change in viscosity (flowability) of a synthetic resin magnet composition according to an example in a molten state.

The preferred embodiments of the present invention will be described below.

Any resin generally used as a binder for a resin magnet can be utilized as a binder resin used in the synthetic resin magnet composition of the present invention. Specifically, various thermoplastic resins such as: polyamide resin, epoxy resin, polypropylene, polyethylene, polystyrene, polyethylene terephthalate (PET), polybutylene terephthalate (PBT), polyphenylene sulfide (PPS), ethylene-vinyl acetate copolymers (EVA), ethylene-ethyl acrylate (EEA), and ethylene-vinyl alcohol copolymers (EVOH) can be used either alone or by combining two or more of them. Particularly in the present invention, it is preferable to use polyamide resins such as polyamide-6, polyamide-12, polyamide-66, polyamide-11, polyamide-46, and polyamide-6.66; and polyamide-6 and polyamide-12 are especially preferred.

Any known magnetic powder conventionally used in synthetic resin magnet compositions for magnetic rollers can be utilized as a magnetic powder being mixed and dispersed into the above-mentioned resin binder. Specifically, examples thereof include ferrite-type magnetic powders such as Sr-ferrite and Br-ferrite, and rare-earth-type alloy powders such as Sm—Co alloys, Nd—F—B alloys, Ce—Co alloys and Sm—Fe—N alloys. If required, the magnetic powder can be pretreated in a known manner, for example, by using a coupling agent for surface-treating. Particularly in the present invention, it is preferable to use a silane-coupling agent or a titanate-coupling agent for applying a coupling treatment. By using magnetic powder having been so coupling-treated, it is possible to effectively improve the melt flowability when a high amount of powder is filled.

The silane-type coupling agent can be: γ-aminopropyl triethoxysilane, γ-aminopropyl trimethoxysilane, N-β-(aminoethyl)-γ-aminopropyl trimethoxysilane, ureidopropyl triethoxysilane, vinyltriethoxysilane, vinyltrimethoxysilane, vinyl-tris(β-methoxyethoxy) silane, γ-metacryloxypropyl trimethoxysilane, γ-metacryloxypropyl triethoxysilane, β-(3,4-epoxycyclohexyl)-ethyl trimethoxysilane, γ-glycidoxyproply trimethoxysilane, γ-mercaptopropyl trimethoxysilane, γ-isocyanatepropyl triethoxysilane, methyl triethoxysilane, methyl trimethoxysilane or the like. Among them, γ-aminopropyl triethoxysilane, γ-aminopropyl trimethoxysilane, N-β-(aminoethyl)-γ-aminopropyl trimethoxysilane, ureidopropyl triethoxysilane and the like are especially preferred.

The titanate-type coupling agent can be: isopropyl bis(dioctyl pyrophosphate) titanate, isopropyl tris(N-aminoethyl-aminoethyl) titanate, isopropyl triisostearoyl titanate, diisopropyl bis(dioctyl pyrophosphate) titanate, tetraisopropyl bis(dioctyl phosphite) titanate, tetraoctyl bis(ditridecylphosphite) titanate, tetra(2,2-diallyloxymethyl-1-butyl) bis(ditridecyl) phosphite titanate, bis(dioctyl pyrophosphate) oxyacetate titanate, bis(dioctyl pyrophosphate) ethylene titanate, or the like. Among them, isopropyl bis(dioctyl pyrophosphate) titanate is especially preferred.

The particle size of the magnetic powder used in the present invention is not to be particularly limited. However, in terms of the melt flowability of the obtained synthetic resin magnet composition, the orientation characteristics of the magnetic powder, the filling factor and other such aspects, the average particle size is preferably 0.05–300 μm, and more preferably, 0.1–50 μm.

Further, the amount of magnetic powder to be mixed is appropriately selected according to the magnetic force strength required for desired molded-products, and is not to be particularly limited. Generally, the amount thereof is about 70–95 wt % of the overall synthetic resin magnet composition (the density being about 2.5–6 g/cm$^3$); however, particularly in the present invention, depending on the effect of the aromatic compound added, it is possible to maintain a good melt flowability of the composition even when a high amount, that is, 80 wt % or more (density being 3 g/cm$^3$ or more), and particularly 80–99 wt % (density being 3–7 g/cm$^3$; in this case the resin binder is 1–20 wt %) is filled. Specifically, it is possible to maintain the good melt flowability of the composition, which is at about 10 g/10 min or more, and particularly about 50–150 g/10 min in "melt-flow rate" (MFR) according to ASTM-D1238 (270 ° C., 49N). Thus, it is possible to achieve a high-magnetization in the synthetic resin magnet molded-product being obtained, without deteriorating its moldability. For the MFR according to ASTM-D1238, there exists an A-method carried out manually and a B-method carried out automatically. As for the present invention, the measurement of MFR can either be by the A-method or by the B-method. Further, as described above, the present invention shows a noticeable effect when a high amount of magnetic powder is filled, but the synthetic resin magnet composition of the present invention is also advantageous in aspects such as for uniform dispersibility of the magnetic powder even when the amount of magnetic powder being filled is not so high.

The synthetic resin magnet composition of the present invention is obtained by mixing and dispersing at least one type of aromatic polyamine compound in the resin binder along with the magnetic powder. Preferably, the aromatic polyamine compound is either a compound represented by the following formula:

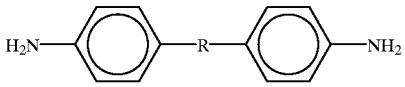

(wherein R is a single bond or a lower alkylene group); or a compound obtained by reacting at least one compound with the above formula with an ether compound having at least one epoxy-group, and more preferably, R in the compound with the above formula reacted with an ether compound is methylene. Further, each of two phenylene groups in the aromatic polyamine compound represented by the above formula may have at least one substituent such as lower alkyl, lower alkoxyl, halogen or the like. Furthermore, it is preferable that the ether compound is either a compound represented by the following formula:

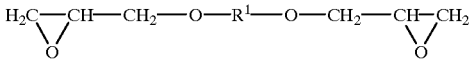

(wherein $R^1$ is an alkylene, a cycloalkylene or an arylene group, each of which may have a substituent); or a compound represented by the following formula:

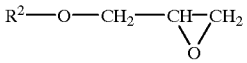

(wherein $R^2$ is an alkyl, a cycloalkyl or an aryl group, each of which may have a substituent).

As preferred examples of an aromatic polyamine compound, mentioned is 4,4'-diamino diphenylmethylene represented by the following formula:

(1)

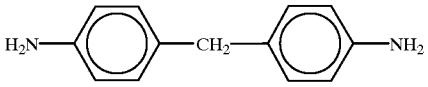

and compounds (4) and (5) added with epoxy-compounds (2) and (3) thereto shown below. (In the formulas below, $R^1$ and $R^2$ are the same groups as described above.)

(2)

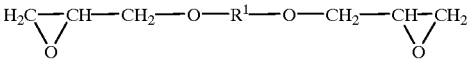

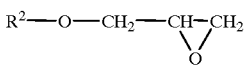

(3)

adducts

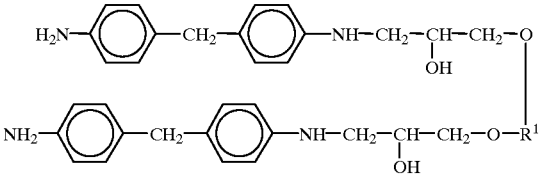

(4)

-continued (5)

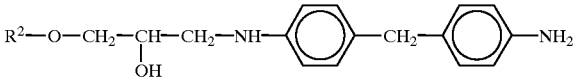

In the present invention, it is preferable to use a mixture of the compounds represented by (1), (4) and (5) above.

The amount of aromatic polyamine compound to be added is not to be particularly limited, but it is preferably 0.1–10 wt %, and particularly, it is preferably 0.5–5 wt %. If the amount to be added is below 0.1 wt %, there are cases in which the effect to prevent deterioration of melt flowability is not sufficient. On the contrary, if the amount exceeds 10 wt %, the amount of magnetic powder being filled will become small, and a composition with satisfactory magnetic features can not be obtained.

If necessary, it is possible to appropriately add fillers having a high reinforcing effect, such as mica, whisker, talc, carbon fiber or glass fiber, to the synthetic resin magnet composition of the present invention along with the resin binder component, the magnetic powder and the aromatic polyamine compound, to an extent in which the fillers do not obstruct the object of the present invention. That is, when the magnetic force required for a molded-product is relatively small and thus the amount of magnetic powder to be added is small, the rigidity of the molded-product tends to be weak. In such a case, in order to strengthen the rigidity, fillers such as mica or whisker can be added to reinforce the molded-product. Here, the filler that can be suitably used for the present invention is preferably mica or whisker. The whisker can either be a non-oxide-type whisker such as silicon carbide and silicon nitride, a metal-oxide-type whisker such as ZnO, MgO, $TiO_2$, $SnO_2$ and $Al_2O_3$, a complex-oxide-type whisker such as potassium titanate, aluminum borate and basic magnesium sulfate or the like. Among them, it is particularly suitable to use a complex-oxide-type whisker considering the point that it can be easily combined with plastics.

The mixing rate when using this filler is not to be particularly limited, but generally, it is to be 0.1–30 wt % of the entire synthetic resin magnet composition, and particularly about 5–20 wt % thereof. Further, an antioxidant can be suitably added, and the amount thereof to be added is preferably 0.1–20 wt %. It is to be noted that additives other than the fillers can be added to the synthetic resin magnet composition of the present invention without any problems as long as it does not depart from the object of this invention.

Further, the synthetic resin magnet molded-product according to the present invention, for example, a magnetic roller is obtained by molding the above-mentioned synthetic resin magnet composition of the present invention. Accordingly, the product is excellent in dimensional precision, has little variation in surface magnetic force, and can also achieve a high-magnetization. That is, since the synthetic resin magnet composition of the present invention can maintain a good melt flowability upon high-amount filling of magnetic powder, even when a high amount of magnetic powder is filled in order to achieve high-magnetization, the composition can flow well within the cavity of a metal mold when molding a magnetic roller or such a product. Therefore, it is possible to obtain a magnetic roller (i.e., a molded-product) having little variation in dimensional precision and surface magnetic force, without causing unsatisfactory orientation/filling of magnetic powder within a metal mold, or causing variation in filling density.

In this case, the molding method for molding a magnetic roller or the like using the above-mentioned synthetic resin magnet composition can be by injection molding, extrusion molding, compression molding or other such methods. Particularly, the effect of the present invention is especially noticeable when molded by the injection-molding method which has a great influence on the quality of molded-products from molding materials possessing melt flowability. Generally, a magnetic roller has a structure comprising a roller body made from a resin magnet, and a shaft portion protruding from both ends of the roller body. Here, a magnetic roller can be obtained by setting a shaft made from metal or the like into a metal mold and then molding the roller body made from the synthetic resin magnet composition around the outer periphery of the shaft, or by integrally molding a shaft portion and a roller body from the synthetic resin magnet composition. Further, when a high-grade and complicating magnetic force characteristic is required, it is possible to form the roller body by molding a plurality of resin magnet pieces using a synthetic resin magnet composition, and then adhesively-attaching them together onto the outer periphery of a shaft made from metal or the like. Here, as a matter of course, it is possible to mold all of the resin magnet pieces from the above-mentioned synthetic resin magnet composition of the present invention, but in some cases, it is possible to mold only the resin magnet pieces which are particularly required to have a high magnetic force by using the synthetic resin magnet composition of the present invention. Further, polarization of the magnetic roller can be conducted simultaneously along with the molding by forming a magnetic field around the metal mold, or, it can be conducted after molding by using a known polarizer.

It is to be noted that although the synthetic resin magnet composition of the present invention is suitably used as a molding material for the above-mentioned magnetic roller, its usage is not to be limited thereto, and the composition can also be suitably used as a molding material for various synthetic resin magnet molded-products.

The present invention will be described below based on examples and comparative-examples.

EXAMPLE 1

An Nd-type rare-earth magnet alloy powder (MQP-B manufactured by GENERAL MOTORS Co., LTD., having average particle size of 250 $\mu$m), having a composition of $Nd_{12}Fe_{78}Co_4B_6$ in wt % of atoms, was pulverized to have an average particle size of 100 $\mu$m, and then surface-treated with a silane coupling agent (A1100 manufactured by NIHON UNIKA K.K.). After precisely measuring 188 g of the surface-treated magnetic powder, it was mixed to 6.8 g of nylon 12 (P3012U manufactured by UBE INDUSTRIES LTD.) used as a resin binder, 3.5 g of antioxidant (IRGANOX MD 1024 manufactured by CIBA SPECIALTY CHEMICALS K.K.) and 1.7 g of aromatic polyamine compound (FUJICURE 6010 manufactured by FUJI KASEI KOGYO CO., LTD.). The mixture was kneaded by a Labo Plastomill of Type No. 50C150 (capacity of 60 $cm^3$) manufactured by TOYO SEIKI KOGYQ CO., LTD. at a rotation speed of 50 rpm while being heated at 250° C. for 15 minutes, and the change in torque-value of the molten-product was measured. In the present example, as for the change in torque in molten-state, it showed no torque increase, i.e., no sign of increase in viscosity after 15 minutes, as shown in figure.

Also, the melt-flow rate (MFR) of the obtained synthetic resin magnet composition measured by a Melt Indexer (manufactured by TOYO SEIKI KOGYO CO., LTD.) was 75.14 g/10 min (270° C., 5 kg), wherein a sufficient melt flowability was obtained. Further, a cylindrical test. piece with a diameter of 20 mm and height of 6 mm was prepared using the obtained synthetic resin magnet composition, and its magnetic energy product (BHmax) measured was 7.1 MGOe, wherein an improvement in magnetic force was accomplished.

Comparative-example 1

A synthetic resin magnet composition was prepared in the same manner as that in Example 1, except that it has a composition of 188g of magnetic powder, 8.5 g of binder resin and 3.5 g of antioxidant. The torque-value of a molten-product of the obtained synthetic resin magnet composition was measured in the same manner as that in Example 1. Torque increase during kneading was not seen (figure), but the MFR-value was 9.84 g/10 min, which being insufficient. Further, the BHmax thereof was 6.5 MGOe. It is to be noted that because of its poor flowability, molding did not succeed.

EXAMPLE 2

5.43 kg of strontium-ferrite (NF110 manufactured by NIHON BENGALA INDUSTRIES, K.K.) was surface-treated with 0.054 kg of silane coupling agent (A1160 manufactured by NIHON UNIKA K.K.). Then, this was mixed to 0.615 kg of nylon 6 (P1010 manufactured by UBE INDUSTRIES LTD.) used as a resin binder and 0.123 kg of aromatic polyamine compound (FUJICURE 6010 manufactured by FUJI KASEI KOGYO CO., LTD.). After kneading with a uniaxial kneader, it was pelletized, and a pellet-like synthetic resin magnet composition was obtained. The melt-flow rate (MFR) of the obtained synthetic resin magnet composition measured by a Melt Indexer (manufactured by TOYO SEIKI KOGYO CO., LTD.) was 94 g/min (270° C., 10 kg), wherein a sufficient melt flowability was obtained. A cylindrical molded-product having a diameter of 9.6 mm was injection molded in a magnetic field using the obtained synthetic resin magnet composition, and the surface magnetic force thereof was measured. The surface magnetic force showed 870 gauss.

Comparative-example 2

A synthetic resin magnet composition was prepared in the same manner as that in Example 2, except that the aromatic polyamine compound (FUJICURE 6010 manufactured by FUJI KASEI KOGYO CO., LTD.) was not added, but instead the amount of nylon 6 (P1010 manufactured by UBE INDUSTRIES LTD.) was increased by 0.123 kg. The melt-flow rate (MFR) of the obtained synthetic resin magnet composition measured by a Melt Indexer (manufactured by TOYO SEIKI KOGYO CO., LTD.) was 45 g/min (270° C., 10 kg), wherein the melt flowability was low. Also, a cylindrical molded-product having a diameter of 9.6 mm was injection molded in a magnetic field using the obtained synthetic resin magnet composition, and its surface magnetic force was measured. The surface magnetic force showed 843 gauss, which was lower compared to Example 2.

As described above, in the synthetic resin magnet composition of the present invention, by adding an aromatic polyamine compound, it is possible to obtain excellent flowability when in molten-state, and maintain a good melt flowability without deterioration in moldability even when the amount of magnetic powder being filled is increased, and thus, can achieve a high-magnetization of the molded-product. Accordingly, by using this synthetic resin magnet composition for producing molded-products such as magnetic rollers, it is possible to render an improvement in magnetic characteristics without causing deterioration in dimensional precision caused by deterioration of moldability, nor variation in surface magnetic force, and thus, it is possible to respond to the demands for a high-magnetization called for in the recent years.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A synthetic resin magnet composition comprising a polyamide resin binder and dispersed therein a magnetic powder and at least one type of aromatic polyamine compound represented by the following formula:

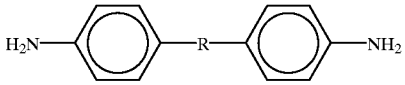

(wherein R is a single bond or a lower alkylene group and wherein the phenylene groups may independently be substituted).

2. A synthetic resin magnet composition according to claim 1, wherein the amount of said aromatic polyamine compound is within a range of 0.1–10 wt %.

3. A synthetic resin magnet composition according to claim 1, wherein said magnetic powder is surface-treated with either a silane coupling agent or a titanate coupling agent.

4. A synthetic resin magnet composition according to claim 1, wherein said resin binder is a polyamide resin.

5. A synthetic resin magnet composition according to claim 1, wherein the amount of said aromatic polyamine compound is within a range of 0.5–5 wt %.

6. A synthetic resin magnet composition according to claim 1, wherein R represents methylene.

7. A synthetic resin magnet composition according to claim 1, wherein said at least one type of aromatic polyamine compound is a mixture of compounds represented by formulae (1), (4) and (5):

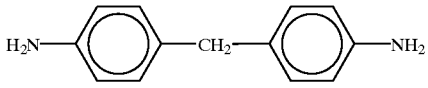

(4)

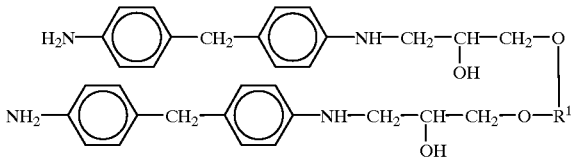

(5)

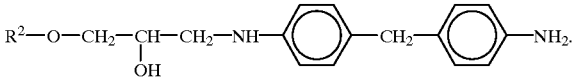

8. A synthetic resin magnet molded-product prepared by molding a synthetic resin magnet composition according to claim 1, into a desired shape.

9. The synthetic resin magnet molded product according to claim 8, wherein the synthetic resin magnet molded product is a magnetic roller.

10. A synthetic resin magnet composition as claimed in claim 1, wherein the phenylene rings are independently unsubstituted or substituted with a substituent selected from the group consisting of a lower alkyl group, a lower alkoxy group and a halogen atom.

11. A synthetic resin magnet composition comprising a synthetic resin binder and dispersed therein a magnetic powder and at least one type of aromatic polyamine compound, wherein said aromatic polyamine compound is a compound obtained by reacting at least one compound with the following formula:

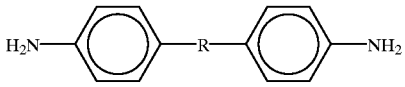

(wherein R is a single bond or a lower alkylene group and wherein the phenylene groups may independently be substituted) with an ether compound having at least one epoxy-group.

12. A synthetic resin magnet composition according to claim 10, wherein said ether compound is a compound represented by the following formula:

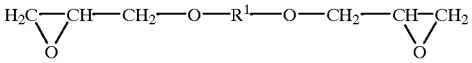

(wherein $R^1$ is an alkylene, a cycloalkylene or an arylene group, each of which may have a substituent).

13. A synthetic resin magnet composition according to claim 10, wherein said ether compound is a compound represented by the following formula:

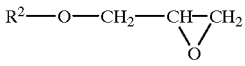

(wherein $R^2$ indicates an alkyl, a cycloalkyl or an aryl group, each of which may have a substituent).

14. A synthetic resin magnet composition according to claim 10, wherein the amount of said aromatic polyamine compound is within a range of 0.5–5 wt %.

15. A synthetic resin magnet composition according to claim 10, wherein R represents methylene.

16. A synthetic resin magnet molded-product prepared by molding a synthetic resin magnet composition according to claim 10 into a desired shape.

17. The synthetic resin magnet molded product according to claim 15, wherein the synthetic resin magnet molded product is a magnetic roller.

18. A synthetic resin magnet composition as claimed in claim 11, wherein the phenylene rings are independently unsubstituted or substituted with a substituent selected from the group consisting of a lower alkyl group, a lower alkoxy group and a halogen atom.

* * * * *